United States Patent [19]

Eckert et al.

[11] 4,100,904

[45] Jul. 18, 1978

[54] FUEL INJECTION SYSTEM

[75] Inventors: Konrad Eckert, Stuttgart; Heinrich Knapp, Leonberg-Silberberg; Gerhard Stumpp, Stuttgart, all of Fed. Rep. of Germany

[73] Assignee: Robert Bosch GmbH, Stuttgart, Fed. Rep. of Germany

[21] Appl. No.: 758,369

[22] Filed: Jan. 11, 1977

Related U.S. Application Data

[63] Continuation of Ser. No. 507,076, Sep. 18, 1974, abandoned.

[30] Foreign Application Priority Data

Sep. 28, 1973 [DE] Fed. Rep. of Germany ..... 2348860

[51] Int. Cl.[2] ..... F02M 37/14

[52] U.S. Cl. ..... 123/139 AW; 123/139 BG; 123/140 MC; 261/50 A

[58] Field of Search ..... 123/139 AW, 139 DP, 123/139 AT, 139 BF, 139 BG, 140 MC; 261/50 A

[56] References Cited

U.S. PATENT DOCUMENTS

| | | | |
|---|---|---|---|
| 2,614,888 | 10/1952 | Nichols | 123/139 AT |
| 3,053,313 | 9/1962 | Ball | 123/139 AF |
| 3,592,176 | 7/1971 | Fenne | 123/139 DP |
| 3,625,192 | 12/1971 | Dreisen | 123/139 AT |
| 3,730,155 | 5/1973 | Knapp | 123/139 AW |
| 3,739,762 | 6/1973 | Jackson | 123/139 AW |
| 3,742,926 | 7/1973 | Kemp | 123/139 DP |
| 3,752,136 | 8/1973 | Knight | 123/139 AT |
| 3,777,727 | 12/1973 | Kirchner et al. | 123/139 AW |
| 3,835,828 | 9/1974 | Knapp | 123/139 AW |
| 3,870,025 | 3/1975 | Anderson et al. | 123/139 AT |
| 3,896,778 | 7/1975 | Zeyns et al. | 123/139 AW |
| 3,919,992 | 11/1975 | Eckert | 123/139 AW |
| 3,929,114 | 12/1975 | Chattopadhayay et al. | 261/50 A |

*Primary Examiner*—Charles J. Myhre
*Assistant Examiner*—Andrew M. Dolinar
*Attorney, Agent, or Firm*—Edwin E. Greigg

[57] ABSTRACT

A fuel injection system employing continuous injection into the induction manifold for varying the fuel-air ratio during the warm-up phase of the engine. A pivoting flap responds to the air flow through the induction tube and rotates a metering valve core. Openings in this valve core cooperate with openings in the valve cylinder to form a metering valve aperture of variable cross-section. The pressure differential across this aperture influences the metered fuel quantity and this pressure differential can be varied during the warm-up phase of the engine. The variation in the pressure differential is accomplished by heating a bi-metallic spring which disengages from the closure element of a diaphragm valve, increasing the closing bias thereof. The resulting increase in fuel pressure downstream of the metering aperture displaces a piston which removes the additional biasing force on another diaphragm valve, permitting the reduction of fuel pressure upstream of the metering aperture with the net effect of a reduction of the pressure differential across the metering aperture and a corresponding reduction of the metered fuel quantity, i.e., a leaning out of the fuel-air mixture.

11 Claims, 3 Drawing Figures

FUEL INJECTION SYSTEM

This is a continuation of application Ser. No. 507,076 filed Sept. 18, 1974, abandoned.

BACKGROUND OF THE INVENTION

The invention relates to a fuel injection system for mixture compressing, externally ignited internal combustion engines employing continuous fuel injection into the induction tube of the engine. These fuel injection systems employ a measuring element located within the induction tube and, in series therewith, an arbitrarily actuatable butterfly valve. The measuring element moves against a resetting force and causes the displacement of the movable part of a valve disposed within the fuel line for the purpose of metering out a fuel quantity proportional to the air quantity flowing through the induction tube.

Fuel injection systems of this type are designed to automatically provide a favorable fuel-air mixture for all operational conditions of the internal combustion engine so as to make possible a complete combustion of the fuel and hence to avoid, or at least to reduce sharply, the generation of toxic components in the exhaust gas while maintaining the highest possible performance or the least possible fuel consumption of the engine. Accordingly, the fuel quantity must be metered out very precisely to correspond to the requirements of each and every operational state of the internal combustion engine.

In known fuel injection systems of this type, the air quantity flowing through the induction tube is sensed by a measuring element and a quantity of fuel proportional to this air quantity is metered out and is injected by injection nozzles into the induction tube in the vicinity of each engine cylinder. The proportionality existing between the air quantity and the fuel quantity may be altered depending on engine parameters such as rpm, load and temperature.

OBJECT AND SUMMARY OF THE INVENTION

It is an object of the invention to provide a fuel injection system of the known type, but requiring substantially less constructional effort and expense which nevertheless meets the above stated demands made on such a fuel injection system.

This object is achieved, according to the invention, in that the pressure of the fuel within parts of the fuel injection system can be reduced for the purpose of enriching the fuel-air mixture during the warm-up phase of the engine.

An advantageous characteristic of the invention provides that the pressure differential across the fuel metering valve may be increased by reducing the main system fuel pressure. The main system pressure, in turn, is changeable by means of a system pressure valve whose biasing pressure can be reduced during the warm-up phase of the internal combustion engine. Advantageously, the system pressure valve is a flat-seat valve with a diaphragm as the movable valve element and can be actuated in the direction of closing by a spring whose bias precompression is reducible by a heatable bimetallic strip spring.

A further advantageous feature of the invention provides a differential pressure valve for maintaining the pressure difference across the fuel metering valve. The differential pressure valve is a flat-seat valve with a diaphragm as its movable valve element which is held in the closed position by a differential pressure spring whose end remote from the diaphragm is supported on a warm-up piston. This warm-up piston moves slidably and against a warm-up spring in a bore of the differential pressure valve housing. The face of the piston near the differential pressure spring is exposed to post-metering fuel pressure and the piston face remote from the differential pressure spring is exposed to the induction tube pressure prevailing downstream of the butterfly valve. The piston may be moved between two stops that determine its end positions.

A still further advantageous feature of the invention is that fuel which leaks past the warm-up piston can be introduced into the induction tube downstream of the butterfly valve.

A supplementary feature of the object of the invention provides an injection nozzle for injecting the meteredout fuel into the induction tube immediately downstream of the butterfly valve.

An especially advantageous feature of the invention is that the metering valve contains a rotating core which is connected by a coupling with the pivotal shaft of the measuring element and that this rotating core has an axial fuel metering groove which variably overlaps metering slits in the valve cylinder for the purpose of metering out fuel. An axial compensation groove is located opposite the axial metering groove in the rotating core. Fuel which leaks past the rotating valve core is returned to the suction side of the fuel pump of the engine. The invention will be better understood as well as further objects and advantages become more apparent from the ensuing, detailed specification of a preferred, although only exemplary embodiment taken in conjunction with the drawing.

BRIEF DESCRIPTION OF THE DRAWING

An examplary embodiment of the invention is represented in the drawing in simplified form.

DESCRIPTION OF THE PREFERRED EMBODIMENT

Figure 1:
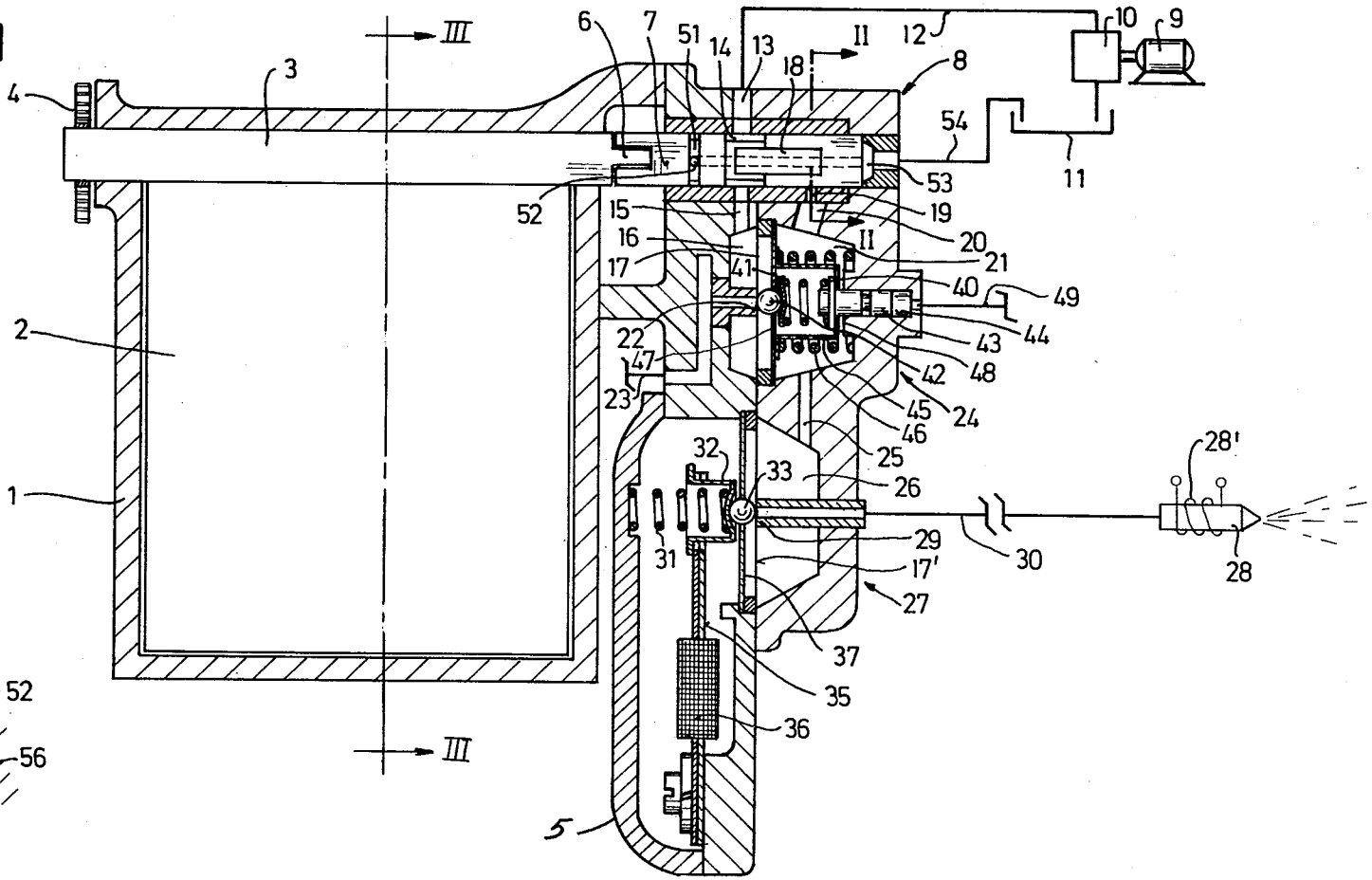
FIG. 1 is a partially sectional diagram of the entire fuel injection system.
Figure 3:
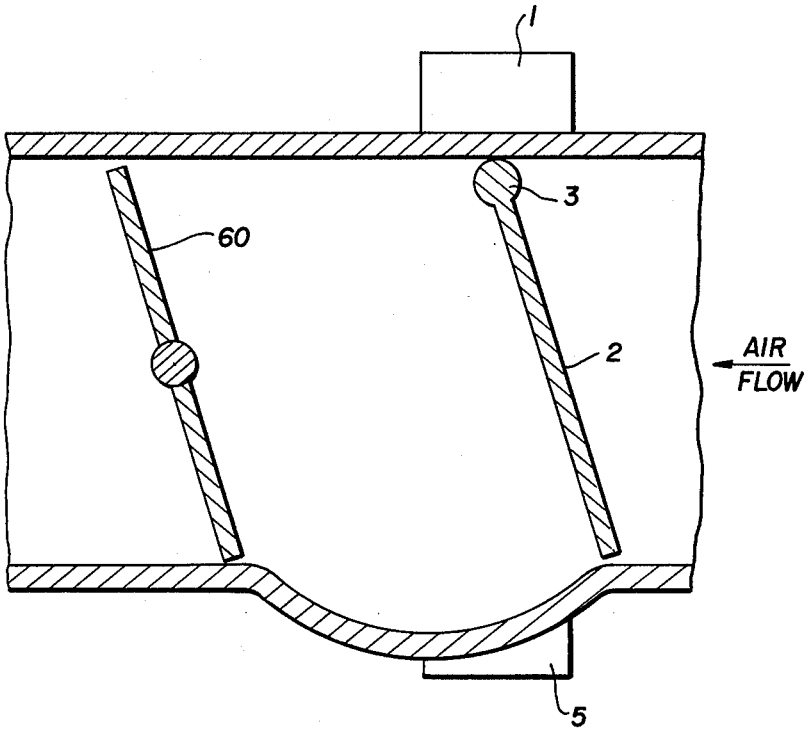
FIG. 3 is a section along line III-III of FIG. 1.

In the fuel injection system represented in FIG. 1, combustion air flows through an air filter (not shown) into an induction tube region 1 which contains an air measuring element 2 embodied as a plate, pivotally mounted at one side on a shaft 3. The air then flows through a region of the induction tube containing an arbitrarily actuatable butterfly valve 60 (FIG. 3) to one or several cylinders (not shown) of an internal combustion engine. The measuring element 2 is disposed transversely with respect to the air flow in the appropriately shaped region 1 of the induction tube (FIG. 3) where it is displaced in accordance with an approximately linear function of the air quantity flowing through the induction tube. If the air pressure prevailing ahead of the measuring element 2 is constant, the pressure prevailing between the measuring element 2 and the butterfly valve will also remain constant. The resetting force acting on the measuring element 2 is exerted by a spiral spring 4, fixedly attached to the shaft 3. The shaft 3 of the air measuring element 2 is connected via a coupling 6 to a rotating valve core 7 which serves as the movable valve element of a fuel metering valve, generally indicated by the numeral 8.

An electric motor 9 drives a fuel pump 10, which delivers fuel from a fuel container 11 through a line 12 to the fuel metering valve 8.

Fuel flows from line 12 through a channel 13 in the housing of the fuel metering valve 8 to an annular groove 14 in the rotating core 7 and thence through a channel 15 to a chamber 16 covered by a diaphragm 17 which is subjected to the pressure of this fuel. The rotating core 7 is provided with an axial metering groove 18 which communicates with the annular groove 14 and which, depending on the angular position of the rotating core, more or less overlaps a fuel metering slit 19 through which the metered-out fuel can flow to a channel 20 and thence to a valve chamber 21. This valve chamber 21 is separated by the diaphragm 17 from the chamber 16 and, together with the valve seat 22 and an overflow bore 23, forms a differential pressure valve, generally indicated by the numeral 24. When the differential pressure valve 24 is open, fuel may flow from chamber 16 over the valve seat 22 and through the overflow bore 23 back to the fuel container at zero gauge pressure. The metered-out fuel flows from chamber 21 of the differential pressure valve 24 through a channel 25 into a chamber 26 of a fuel system pressure valve 27 which is embodied as a flat seat valve containing a diaphragm 17', which may be a part of the same membrane as is the diaphragm 17, and a fixed valve seat 29. When the fuel system pressure valve 27 is open, the metered out fuel may flow from chamber 26 over the fixed valve seat 29 into an injection line 30 leading to a fuel injection valve 28 which is disposed in the induction tube immediately downstream of the butterfly valve and which is equipped with an electric heating element 28' for heating the fuel.

The fuel system pressure valve 27 contains a spring 31 which exerts a biasing force in the direction of closing. The free end of this spring 31 is covered by a spring support cup 32 in which a ball 33 is fixedly held by a locating foil 37, and the other end engages a wall 5. The force of the spring 31 urges the ball against the diaphragm 17', which is thereby pressed against the valve seat 29. Before and during the warm-up phase of the internal combustion engine, the free end of a bimetallic strip spring 35 so engages the spring support cup 32 that the biasing compression of spring 31 is effectively reduced. When the warm-up phase of the internal combustion engine is terminated, an electric heating element 36 may heat the bimetallic spring so as to bend it in the direction of the diaphragm 17, causing it to disengage from the spring support cup 32.

The differential pressure valve 24 contains a differential pressure spring 40 which urges it in the direction of closing and whose one end is supported on a spring support disk 41, fixedly attached to a ball 42 touching the diaphragm 17 and whose other end is supported by a warm-up piston 43. The warm-up piston 43 is slidably supported in a bore 44 within the housing of the differential pressure valve 24. Attached to the piston 43 is a bracket 45 supporting a warm-up spring 46 which tends to maintain the warm-up piston in the position it occupies when the engine is cold.

Before and during the warm-up phase of the internal combustion engine, the warm-up piston 43 assumes a position permitting the spring 46 to urge the bracket 45 against a locating foil 47 positioning the ball 42. The warm-up piston may be displaced within bore 44 against the force of the warm-up spring 46 until the bracket 45 touches a shoulder 48 within the housing of the differential pressure valve. Fuel which leaks past the warm-up piston 43 within the bore 44 is carried through a line 49 and introduced into the induction tube in a manner (not shown) immediately downstream of the butterfly valve.

Fuel leaking past the rotating valve core 7 is collected in a groove 51 and flows through a bore 52 into a space 53 from which it is returned through a line 54 to the fuel container 11.

Figure 2:
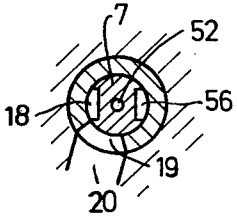
FIG. 2 is a section along the line II-II of FIG. 1.

FIG. 2 is a cross-sectional view on line II—II of FIG. 1 showing the rotating valve core 7 and a compensation groove 56, which is positioned diametrically opposite the axial metering groove 18. The compensation groove 56 equalizes the pressures acting on the rotating core 7.

The method of operation of the fuel injection system is as follows:

When the internal combustion engine is running, the fuel pump 10, driven by the electric motor 9, pumps fuel from the fuel container 11 and delivers it through line 12 to the fuel metering valve 8. At the same time, the internal combustion engine aspirates air through the induction tube 1, and the air displaces the air measuring element 2 from its normal position. Depending on the extent of the displacement of the measuring element 2, the coupling 6 rotates the valve core 7. This rotation enlarges the flow cross-section formed by the fuel metering groove 18 and the fuel metering slit 19. The direct coupling between the air measuring element 2 and the rotating valve core 7 results in a constant ratio of aspirated air quantity to metered-out fuel quantity.

In order to prevent undesirable effects due to changes in the fuel pressure during the metering process, a constant pressure differential is maintained by the differential pressure valve 24 during the metering process. Before and during the warm-up phase of the internal combustion engine, the force exerted by the differential pressure spring 40 is augmented by the force of the warm-up spring 46 transmitted via the warm-up piston 43. This augmented closing force results in a greater pressure differential and an increased quantity of metered-out fuel. When the warm-up phase of the internal combustion engine is terminated, the electric heating element 36 has heated the bimetallic spring 35 so that it moves toward the diaphragm 17 and disengages from the spring support cup 32 within the fuel system pressure valve 27. As a result, the full force of spring 31 operates in the direction of closing the fuel system pressure valve resulting in an increase of the main system pressure. At this point, the main system pressure, acting on the warm-up piston 43, suffices to displace it against the force of the warm-up spring 46 until the bracket 45 touches the shoulder 48 within the housing of the differential pressure valve, thus reducing the closing force exerted by the differential pressure spring 40 against the diaphragm 17 and hence reducing the pressure differential itself, thereby reducing the quantity of fuel metered-out.

What is claimed is:

1. In a fuel injection system for mixture compressing, externally ignited internal combustion engines, which provides continuous fuel injection into the induction tube of the engine and which includes a fuel pump, a housing, a displaceably mounted air measuring member, means providing a resetting force to the displacement of the air measuring member, and a fuel metering valve with the air measuring member being mounted within the induction tube of the engine in series relation with an arbitrarily adjustable butterfly valve, and with the fuel metering valve being mounted within the housing and having a movable valve member which is displaced by the movements of the air measuring member so as to provide fuel metering in proportion to the air flow, the improvement comprising:

means for changing the fuel pressure downstream of the fuel metering valve in the fuel injection line whereby the fuel air mixture ratio is mediately changed; and means for changing the differential pressure across the metering valve, which operate in response to the change in the fuel pressure downstream of the fuel metering valve, wherein said means for changing the differential pressure includes:

a differential pressure valve connected to the fuel metering valve for setting the pressure differential across the fuel metering valve, said differential pressure valve being embodied as a flat-seat diaphragm valve;

a differential pressure spring, for biasing the differential pressure valve in the direction of closure;

a warm-up piston, slidingly disposed in the housing; and a warm-up spring, said warm-up spring biasing the differential pressure valve in the direction of closure; whereby said warm-up piston mediately supports one end of said differential pressure spring and mediately supports one end of said warm-up spring.

2. An improved fuel injection system as defined in claim 1, wherein said means for changing the differential pressure further includes two stops for limiting the sliding motion of said warm-up piston, and means for exposing one face of the piston to fuel pressure downstream of the metering valve, and means for exposing the other face of the piston to induction tube vacuum.

3. An improved fuel injection system as defined in claim 2, wherein said means for changing the differential pressure further includes means for delivering fuel leaking past and warm-up piston to the induction tube of the engine.

4. In a fuel injection system for mixture compressing, externally ignited internal combustion engines, which provides continuous fuel injection into the induction tube of the engine and which includes a fuel pump, a housing, a displaceably mounted air measuring member, means providing a resetting force to the displacement of the air measuring member, and a fuel metering valve, with the air measuring member being mounted within the induction tube of the engine in series relation with an arbitrarily adjustable butterfly valve, and with the fuel metering valve being mounted within the housing and having a movable valve member which is displaced by the movements of the air measuring member so as to provide fuel metering in proportion to the air flow, the improvement comprising:

means for changing the fuel pressure downstream of the fuel metering valve in the fuel injection line; whereby the fuel air mixture ratio is mediately changed, which includes a pressure control valve in the form of a flat seat diaphragm valve, which is located in the housing and connected to the fuel line downstream of said metering valve and which includes a biasing spring which biases the valve in the direction of obturation, a bimetallic strip spring, and means for affixing said bimetallic strip spring in the housing for changing the force of the biasing spring in said pressure control valve during the warm-up phase of the internal combustion engine.

5. In a fuel injection system for mixture compressing, externally ignited internal combustion engines, which provides continuous fuel injection into the induction tube of the engine and which includes a fuel pump, a housing, a displaceably mounted air measuring member, means providing a resetting force to the displacement of the air measuring member, a fuel metering valve and means connected between the fuel pump and the fuel metering valve for delivering fuel from the fuel pump to the fuel metering valve, with the air measuring member being mounted within the induction tube of the engine in series relation with an arbitrarily adjustable butterfly valve, and with the fuel metering valve being mounted within the housing and having a movable valve member connected to the air measuring member for displacement by the movements of the air measuring member so as to provide metering of the fuel delivered by the fuel pump to the fuel metering valve in proportion to the air flow within the induction tube, the improvement comprising:

means defining a fuel flow path downstream of the fuel metering valve;

means located downstream of the fuel metering valve and operating on the fuel flow path for changing the fuel pressure downstream of the fuel metering valve, whereby the fuel-air mixture ratio is mediately changed; and means for changing the differential pressure across the metering valve which operate in response to the change in the fuel pressure downstream of the fuel metering valve.

6. In a fuel injection system for mixture compressing, externally ignited internal combustion engines, which provides continuous fuel injection into the induction tube of the engine and which includes a fuel pump, a housing, a displaceably mounted air measuring member, means providing a resetting force to the displacement of the air measuring member, a fuel metering valve and means connected between the fuel pump and the fuel metering valve for delivering fuel from the fuel pump to the fuel metering valve, with the air measuring member being mounted within the induction tube of the engine in series relation with an arbitrary adjustable butterfly valve, and with the fuel metering valve being mounted within the housing and having a movable valve member connected to the air measuring member for displacement by the movements of the air measuring member so as to provide metering of the fuel delivered by the fuel pump to the fuel metering valve in proportion to the air flow within the induction tube, the improvement comprising:

means defining a fuel flow path downstream of the fuel metering valve;

means located downstream of the fuel metering valve and operating on the fuel flow path for changing the fuel pressure downstream of the fuel metering valve, whereby the fuel-air mixture ratio is mediately changed;

a shaft, having a longitudinal axis about which the shaft is rotatable, to which the air measuring member is mounted, so that the displacement of the air measuring member is rotatable displacement about the shaft axis;

said movable valve member, which comprises a rotatable metering valve core including a metering groove, which varies an effective fuel metering aperture, depending on the position of the metering groove; and a coupling, for directly coupling the shaft to the metering valve core so that the air measuring member and the metering valve are rotatably displaceable together about the shaft axis;

whereby rotary movement of the air measuring member is directly transmitted by the coupling to the metering valve core, whose resulting rotary movement causes displacement of the metering groove, and thus a change in the effective fuel metering aperture.

7. An improved fuel injection system as defined in claim 6, wherein said rotatable metering valve core includes an axial compensation groove located diametrically opposite to said metering groove.

8. In a fuel supply system for mixture compressing, externally ignited internal combustion engines, which provides continuous fuel into the induction tube of the engine and which includes a fuel source, a housing, a displaceably mounted air measuring member, means providing a resetting force to the displacement of the air measuring member, a fuel metering valve and means connected between the fuel source and the fuel metering valve for delivering fuel from the fuel source to the fuel metering valve, with the air measuring member being mounted within the induction tube of the engine in series relation with an arbitrarily adjustable butterfly valve, and with the fuel metering valve being mounted within the housing and having a movable valve member connected to the air measuring member for displacement by the movements of the air measuring member so as to provide metering of the fuel delivered by the fuel source to the fuel metering valve in proportion to the air flow within the induction tube, the improvement comprising:

a shaft, having a longitudinal axis about which the shaft is rotatable, to which the air measuring member is mounted, so that the displacement of the air measuring member is rotatable displacement about the shaft axis;

said movable valve member, which comprises a rotatable metering valve core including a metering groove, which varies an effective fuel metering aperture, depending on the position of the metering groove;

said shaft being directly connected to the metering valve core so that the air measuring member and the metering valve are rotatably displaceable together about the shaft axis; and whereby rotary movement of the air measuring member is directly transmitted to the metering valve core, whose resulting rotary movement causes displacement of the metering groove, and thus a change in the effective fuel metering aperture.

9. An improved fuel supply system as defined in claim 8, further comprising:

means defining a fuel flow path downstream of the fuel metering valve; and means located downstream of the fuel metering valve and operating on the fuel flow path for changing the fuel pressure downstream of the fuel metering valve, whereby the fuel-air mixture ratio is mediately changed.

10. An improved fuel injection system as defined in claim 6, wherein said means for changing the fuel pressure further includes means for conducting fuel leaking past said rotatable valve core back to the inlet side of the fuel pump of the engine.

11. An improved fuel supply system as defined in claim 8, further comprising a coupling for directly connecting the shaft to the metering valve core.

* * * * *